US005261689A

United States Patent [19]

Carpenter et al.

[11] Patent Number: 5,261,689

[45] Date of Patent: Nov. 16, 1993

[54] SNOWBOARD BOOT BINDING SYSTEM

[75] Inventors: Jake B. Carpenter, Manchester Center; David Dodge, Shelburne, both of Vt.

[73] Assignee: Burton Corporation USA, Burlington, Vt.

[21] Appl. No.: 826,598

[22] Filed: Jan. 28, 1992

[51] Int. Cl.[5] ..... A63C 9/02

[52] U.S. Cl. ..... 280/618; 280/633; 280/14.2; 441/70

[58] Field of Search ..... 441/70; 280/14.2, 607, 280/617, 618, 626, 629, 634, 633

[56] References Cited

U.S. PATENT DOCUMENTS

| | | | |
|---|---|---|---|
| 2,740,972 | 4/1956 | Taylor | 441/70 |
| 2,919,452 | 1/1960 | Kluge | 441/70 |
| 3,172,678 | 3/1965 | Beyl | 280/620 |
| 3,295,859 | 1/1967 | Perry | 280/601 |
| 4,040,137 | 8/1977 | Fetherston et al. | 441/70 |
| 4,718,873 | 1/1988 | Shaw et al. | 441/70 |
| 4,871,337 | 10/1989 | Harris | 441/70 |
| 5,021,017 | 6/1991 | Ott | 441/70 |
| 5,046,746 | 9/1991 | Gierveld | 280/11.22 |

FOREIGN PATENT DOCUMENTS

| | | | |
|---|---|---|---|
| 398794 | 11/1990 | European Pat. Off. | 280/14.2 |
| 2627097 | 8/1989 | France | 280/14.2 |

*Primary Examiner*—Margaret A. Focarino
*Assistant Examiner*—Michael Mar
*Attorney, Agent, or Firm*—Darby & Darby

[57] ABSTRACT

A snowboard binding system having a binding plate, the bottom of which is supported on a snowboard. The plate includes a circular opening in its center which receives a disk shaped hold-down plate. The hold-down plate may be secured to the board in several different positions on the board with the binding plate assuming any rotational position with respect to the hold-down plate. Additionally, a highback support attached at the rear of the binding plate may be rotated along an axis generally normal to the binding plate (and therefore the board) and secured in its rotated position, to enable a rider to transmit forces to the snowboard from a variety of stance positions.

15 Claims, 3 Drawing Sheets

SNOWBOARD BOOT BINDING SYSTEM

FIELD OF THE INVENTION

This invention relates generally to boot binding systems for snowboards. More specifically, the invention relates to a snowboard binding having multiple degrees of freedom and adjustability.

BACKGROUND OF THE INVENTION

A recently popular sport, snowboarding presents operating conditions and physical demands not found in other skiing-type sports. In snowboarding, the operator stands with both feet on the snowboard, somewhat similar to a slalom water ski. However, in waterskiing, the operator is pulled in a single direction by a power boat. The strength and positioning requirements of the attachment apparatus used for securing the operator's feet to the ski are therefore quite limited.

In snowboarding, since the motive force is provided by gravity as the rider travels down a hill, the rider is able to and often must assume body positions not often found in other sports. Specifically, the angle between the midline of the foot and the midline of the snowboard is often greatly altered for different snowboarding styles, such as acrobatics or simple traveling, and for different athletes.

It is often the case that either a boot worn by the rider or the binding itself will be provided with a support for the lower leg just above the ankle. However, when the angle of the midline of the foot with respect to the board is changed, this can also change the angle between the leg and the foot. Currently, a simple, rigid support that is merely perpendicular to the board and aligned along the midline of the foot is used. Some of these supports have the capability to fold down against the snowboard surface. Other degrees of freedom are available, but only by disassembly and reassembly of the binding and snowboard.

Different riders also have differing requirements as to the distance between the two bindings on the board as well as the binding's position with respect to the lateral dimension of the board.

Thus it is an object of the invention to provide a boot binding system for a snowboard that has several degrees of freedom along the surface of the board.

It is a further object of the invention to provide a boot binding system providing freedom about a normal to the surface of the board.

It is yet another object of the invention that the boot binding system be collapsible for storage and transport.

It is a still further object of the invention that the boot binding system be simple and cost effective to manufacture, yet reliable and efficient in use.

SUMMARY OF THE INVENTION

In accordance with a preferred embodiment demonstrating further objects, features, and advantages of the invention, a boot binding system comprises a binding plate, the bottom of which is supported on a snowboard. The plate includes a circular opening in its center which receives a disk shaped hold-down plate. The hold-down plate may be secured to the board in several different positions on the board with the binding plate assuming any rotational position with respect to the hold-down plate. Additionally, a highback support attached at the rear of the binding plate may be rotated along an axis generally normal to the binding plate (and therefore the board) and secured in its rotated position, to enable a rider to transmit forces to the snowboard from a variety of stance positions.

BRIEF DESCRIPTION OF THE DRAWINGS

The foregoing and other objects, features and advantages of the present invention will be understood more completely by those skilled in the art upon reading the following detailed description in conjunction with a review of the appended drawings, in which.

DETAILED DESCRIPTION OF THE PREFERRED EMBODIMENTS

Figure 1:
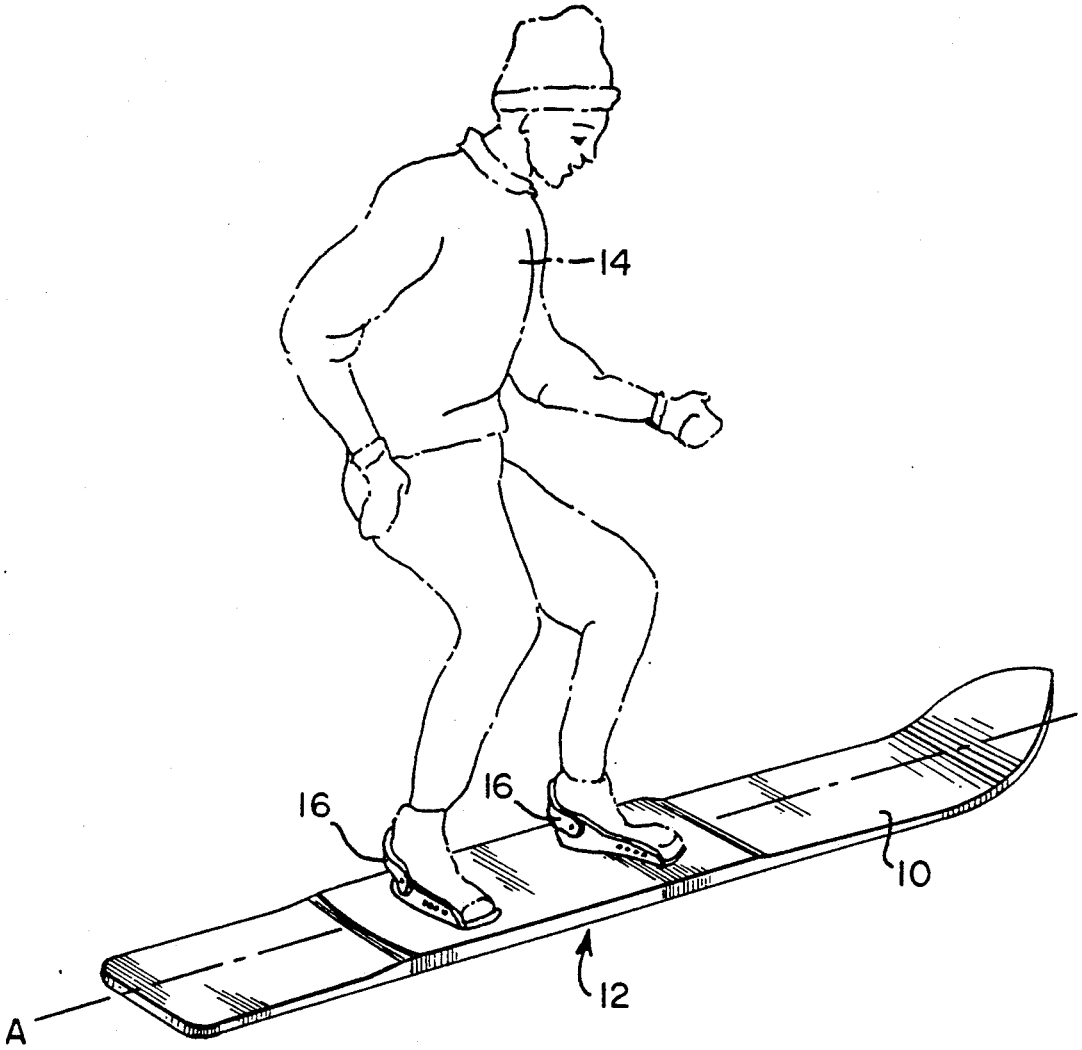
FIG. 1 is a perspective view of a rider on a board having a snowboard binding system according to the invention.

Referring now to the details of the drawings, FIG. 1 shows a snowboard 10 having a snowboard binding system 12 according to the present invention, with a rider 14 having his feet engaged in the system. As can be seen in the figure, the center line of each of the rider's feet, i.e., a line from the heel to the toe, is situated at an angle to the center line A of the board 10. It can also be seen generally that, at each of the rider's ankles, the angle between the lower leg and the foot is somewhat different with each leg, partially due to the spread of the feet and also the varied angle of the feet with respect to the center line of the board 10.

Figure 2:
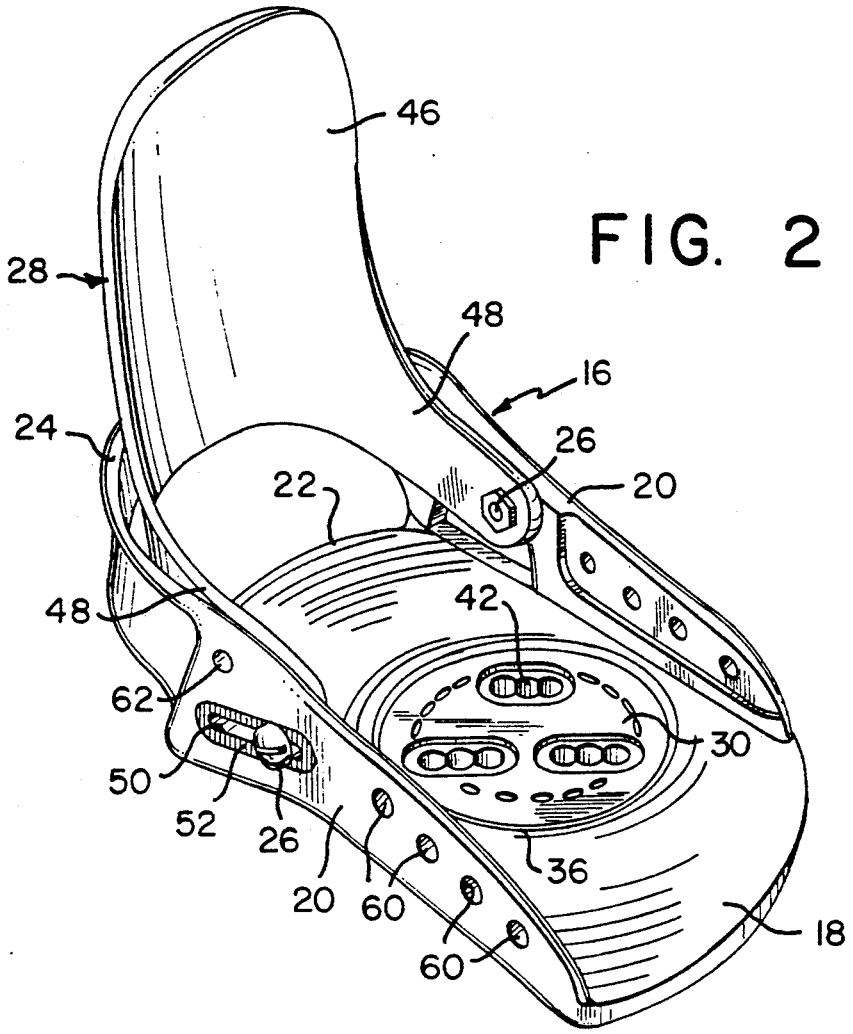
FIG. 2 is a perspective view of a single snowboard binding according to the present invention.
Figure 3:
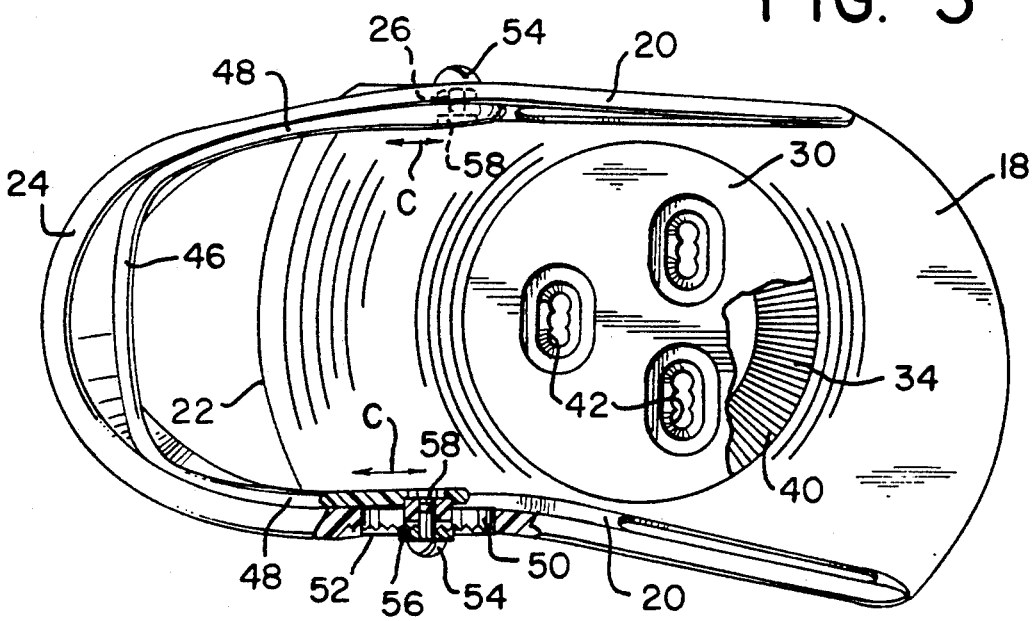
FIG. 3 is a top view of a snowboard binding according to the present invention.

Support for the feet, preferably wearing a boot, and the lower legs while in this and various other body positions is provided by each individual binding 16. In FIG. 2, the base binding plate 18 that is mounted to the top of the snowboard 10 (FIG. 4) is seen with two side walls 20 rising from it near the heel 22 of the plate 18. At the heel 22 the two side walls 20 preferably extend rearward of the binding plate 16 and connect to form a curved heel wall 24 (FIG. 3).

Figure 4:
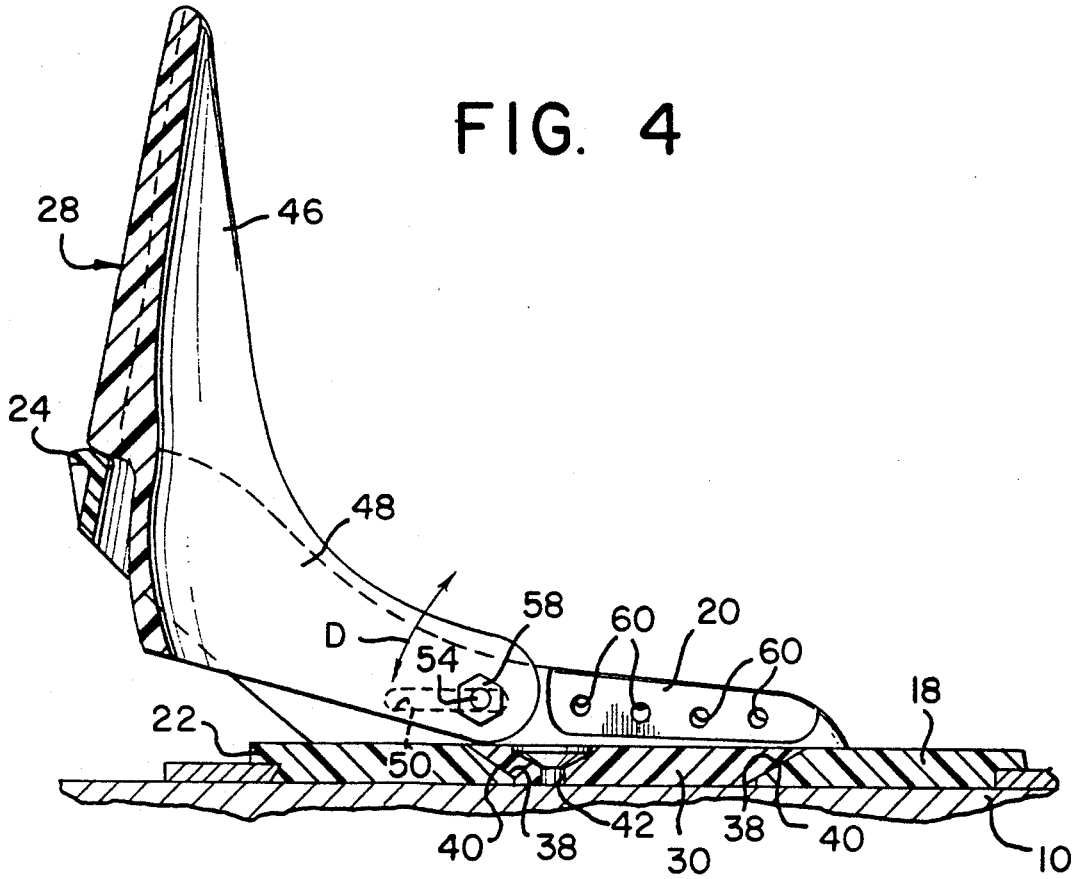
FIG. 4 is a cross sectional view taken along the line IV—IV of FIG. 3 and looking in the direction of the arrows.

Mounted at two connection points 26 to the side walls 20 is a highback leg support 28 which is adjustable as described more fully below. As seen in FIGS. 3 and 4, the binding plate 18 is attached to the snowboard 10 through the use of a hold-down plate 30 having splines, ribs or ridges 32 on at least a portion of its under surface that engage complimentary splines, ribs or ridges 34 on a central aperture 36 in the binding plate 18. As will be described more fully below, the structure of these various components of the binding 16 allows for freedom of movement of the binding plate 18 along the center line A of the board, movement lateral to the center line A of the board, rotation about an axis normal to the board, and rotation of the leg support 28 toward the binding plate 18 and about an axis normal to the board 10.

The hold-down plate 30 preferably has an inverted frusto-conical shape where the sloped walls 38 include the ridges 32 that engage the binding plate 18. The aperture 36 in the binding plate 18 has a complimentary frusto-conical shape with sloped walls 40 having complimentary ridges 34. Both sets of ridges 32,34 are symmetrical around their entire circumferences so that they will mate at many discrete positions.

For connection to the board 10, the hold-down plate 30 includes three screw-receiving holes 42 which are arranged so as to lie at the vertices of an equilateral triangle.

The pattern of holes 42 of the hold-down plate is repeated on the hold-down plate 30 three times in laterally shifted orientation. Preferably, the three repetitions of each hole 42 overlap as shown in FIGS. 2 and 3 for quick adjustment by loosening the screws (not shown) used to mount the plate 30, but not removing them, and sliding the hold-down plate 30. Alternatively, the three repetitions of holes 42 could be separate or could be merged into a single oblong hole. The three repetitions of the holes 42 allow the hold-down plate 30 to be shifted to either side of the board in order to achieve further positioning flexibility of the binding plate 18 on the board 10.

Figure 5:
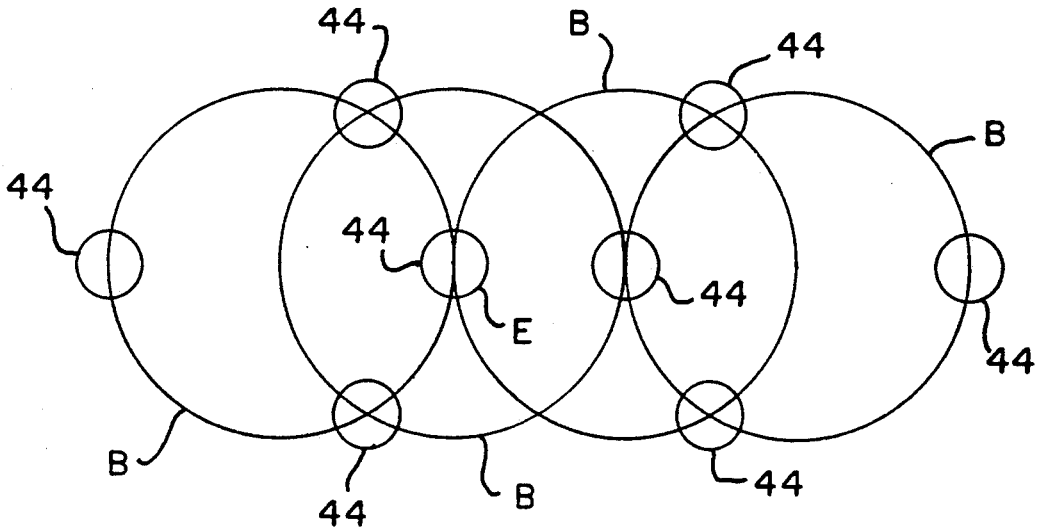
FIG. 5 is a schematic view of the pattern of a set of screw-receiving openings formed in a snowboard using the snowboard binding system of the present invention.

In addition, a similar pattern of holes 44 is provided on the board 10 to match the equilateral orientation of the holes 42 in the hold-down plate 30 and is repeated twice. Each pattern repetition includes a fourth hole intermediate to two of the holes of the equilateral triangle and being on a circle intersecting the three holes of the triangle. Also, the two triangles are arranged so that they are rotated by 180° with respect to each other, placing the two intermediate holes as close as possible to each other. The pattern of holes 44 permits the hold-down plate 30 to be oriented in four positions that are displaced from each other along the length of the snowboard. Each possible position of the hold-down plate 30, not taking into account the three repetitions of holes 42, is indicated by a circle B in FIG. 5. The pattern 44 permits the hold-down plate 30 to be mounted in two positions facing in one direction and two positions facing the other direction, for a total of four positions, since the rotation of the hold-down plate 30 with respect to the center line A of the board 10 is irrelevant, ? .1 because the binding plate 18 may be rotated a full 360° relative to the hold-down plate 30. It can be seen, for example, that the two rightmost positions B (as seen in FIG. 5) are formed by adding only one additional hole 44 (at position E) to those holes 44 already used to form the rightmost position B.

Once the particular set of holes 44 in the board 10 is determined, the particular repetition of holes 42 in the hold-down plate 30 and its rotational orientation are chosen, the binding plate 18 is held at the desired angular position while the hold-down plate 30 is mounted on top of the binding plate 18 and screwed into the board 10. The holes 44 in the board 10 may also include metal sleeves having internal threads for sturdier connection to the hold-down plate 30. It will also be appreciated by those skilled in the art that the pattern of holes 44 could be formed in a plate (not shown) embedded within or mounted onto the board 10.

It will be appreciated that the construction of the binding plate and hole pattern permit a great deal of freedom in adjusting the position of the bindings fore and aft, laterally and rotationally on the board, as well as the spacing between them. It will also be appreciated by those skilled in the art that the hold-down plate 30 need not be round to achieve the advantages of the pattern of holes 44, but should be symmetrical when rotated 180°.

The highback leg support 28 embodying the present invention includes an upright portion 46 and two forward diagonally extending arms 48 terminating at connection points 26 with the side walls 20 of the binding plate 18. These two connection points 26 allow pivoting of the highback 28 to a forward closed position (folded down) (indicated by arrow D, FIG. 4) for transport or storage.

The highback 28 may also be rotatably adjusted about the vertical axis (indicated by arrow C, FIG. 3) due to several structural elements. At the heel of the binding 16 the contacting surfaces of the highback 28 and the heel wall 24 of the binding plate 18 are both generally semi-cylindrical having similar radii. Additionally, the connection points 26 of the highback 28 are bolted through mounting holes 50 that are oblong along the length of the side walls 20. Therefore, it is possible to move one connection point 26 towards the heel while moving the other connection point 26 towards the toe of the binding 16, creating a rotation of the highback 28 about the vertical axis.

To insure positive locking of the highback 28 in its rotated position, the outer surface of the side walls 20 adjacent the oblong mounting holes 50 is provided with splines, ribs or ridges 52. Preferably, a bolt 54 and washer 56 are used with a corresponding nut 58 to lock the connection points 26 in place, the washer 56 having complimentary splines, ribs or ridges to those around the oblong mounting holes 50.

The preferred binding 16 shown in FIGS. 2, 3 and 4 is specifically designed for a left foot in that the front of the binding plate is skewed to the right side to accommodate the ball and large toe of the foot. Of course, this can simply be mirror-imaged to result in a similar binding for the right foot. The front areas of the side walls 20 are preferably provided with a plurality of holes 60 or any other attachment points necessary to attach accessories (not shown) to the binding 16, such as straps for holding a boot in the binding. A similar hole 62 is formed toward the rear of the side walls 20 for attachment of an ankle strap (not shown).

All of the components of the binding system 12 shown in FIGS. 1–4, except the nut 58, bolt 54 and washer 56 used to secure the highback 28, are preferably formed of a high impact, high strength plastic, such as polycarbonate or any other known plastic material. These components can be formed by injection molding or any known manufacturing technique. Of course, other materials able to withstand the significant forces exerted during operation of the snowboard can be used similarly.

While the preferred embodiments shown and described are fully capable of achieving the objects of the present invention, these embodiments are shown and described only for the purpose of illustration and not for the purpose of limitation, and those skilled in the art will appreciate that many additions, modifications and substitutions are possible without departing from the scope and spirit of the invention as defined in the accompanying claims.

What is claimed is:

1. A snowboard binding system for a snowboard, comprising:

a hold-down plate, said plate including at least three first holes extending in a common direction and three of said first holes thereof being arranged in a triangular configuration;

a base plate forming a part of a binding for receiving the leg of a user and having an aperture shaped and sized for receiving said hold-down plate in at least two rotational orientations;

means defining a pattern of second holes in said snowboard, said pattern formed such that said first holes are aligned with a like number of second holes when said hold-down plate is placed over said snowboard for permitting said hold-down plate to assume at least two spaced apart positions along said snowboard, each corresponding to a different rotational orientation of said hold-down plate; and fastening means extending through said first holes in alignment with said like number of second holes for securing said hold-down plate to said snowboard.

2. A snowboard binding system as in claim 1, wherein said pattern includes less than twice the number of said first holes.

3. A snowboard binding system as in claim 1, wherein said hold-down plate is round.

4. A snowboard binding system as in claim 1, wherein said hold-down plate has an inverted frusto-conical shape with a first sloped sidewall, said aperture having a complementary sloped sidewall, said sidewalls engaging each other.

5. A snowboard binding system as in claim 4, wherein said sidewalls have ridges to prevent relative rotation between said hold-down plate and said base plate when secured to said board.

6. A snowboard binding system as in claim 1, wherein each of said first holes comprises three overlapping holes.

7. A snowboard binding system as in claim 1, wherein said base plate has a rear and further comprising:

a highback leg support, said support positioned near said rear and extending substantially perpendicular to said base plate; and means for mounting said support for rotational movement relative to said base plate about an axis generally normal to said plate, said mounting means including means for fixing said highback leg support in its rotational orientation.

8. A binding as in claim 7, wherein said base plate further comprises a side wall, said support being attached to said side wall.

9. A binding as in claim 8, wherein said means for mounting comprises an oblong hole in said sidewall, parallel to said plate, and a releasable fastener through said hole to said support.

10. A binding as in claim 7, wherein said base plate has two sidewalls, said support being connected to each of said sidewalls.

11. A binding as in claim 10, wherein said two sidewalls merge behind the rear of said support to form a heel wall, and said leg support and heel wall are semicylindrical and nested.

12. A binding as in claim 7, wherein said support is rotatable about an axis parallel to said plate.

13. In a snowboard binding system of the type utilizing a triangular arrangement of at least three cooperating fastening means to form a basic pattern for retaining a binding base plate to the snowboard, for engagement with a plurality of fastening elements located in the snowboard, the fastening elements being located in an arrangement:

first, second, and third fastening elements arranged to duplicate said basic pattern;

a fourth fastening element positioned at the center of a first circle passing through said first, second and third fastening element;

fifth and sixth fastening elements located on a second circle centered on one of said first, second and third elements and passing through said fourth element, said fifth and sixth elements being positioned to duplicate the basic pattern in combination with said fourth element.

14. A snowboard binding system in accordance with claim 13, further comprising a seventh fastening element located on a third circle passing through the center of said second circle and said fifth and sixth elements, said seventh element being positioned so as to define said basic pattern in cooperation with said fifth and sixth elements.

15. A snowboard binding system in accordance with claim 14, further comprising an eighth fastening element positioned on a circle passing through said fourth element and two of said first second and third elements which are outside said second circle, said eighth element being positioned to define said basic pattern in combination with said two elements.

* * * * *

UNITED STATES PATENT AND TRADEMARK OFFICE
Certificate

Patent No. 5,261,689 Patented: November 16, 1993

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jake B. Carpenter, Burlington, VT; David Dodge, Williston, VT; Andrus Laats, Cardiff, CA; and Paul I. Wren, III, Montecito, CA.

Signed and Sealed this Twenty-eighth Day of October 2003.

BRIAN L. JOHNSON
*Supervisory Patent Examiner*
Art Unit 3618